US005866840A

United States Patent [19]

Briére et al.

[11] Patent Number: 5,866,840

[45] Date of Patent: Feb. 2, 1999

[54] NOZZLES FOR PYROPHORIC IR DECOY FLARES

[75] Inventors: Paul Briére; Michel St-Onge, both of Neufchâtel; André Roy, St-Nicolas, all of Canada

[73] Assignee: Her Majesty the Queen in right of Canada, as represented by the Minister of National, Ottawa, Canada

[21] Appl. No.: 932,626

[22] Filed: Sep. 17, 1997

[51] Int. Cl.[6] ..... F42B 4/26

[52] U.S. Cl. ..... 102/336; 102/363; 102/370

[58] Field of Search ..... 102/336, 363, 102/370, 364

[56] References Cited

U.S. PATENT DOCUMENTS

| | | | |
|---|---|---|---|
| 3,940,605 | 2/1976 | Gerber | 102/336 X |
| 3,970,003 | 7/1976 | Hayward et al. | 102/336 |
| 4,463,679 | 8/1984 | Billard | 102/336 |
| 5,136,950 | 8/1992 | Halpin et al. | 102/336 |
| 5,343,794 | 9/1994 | Andreotti et al. | 102/336 X |
| 5,390,605 | 2/1995 | Meili et al. | 102/336 |
| 5,400,712 | 3/1995 | Herbage | 102/361 |
| 5,585,594 | 12/1996 | Pelham | 102/336 |
| 5,631,441 | 5/1997 | Briere et al. | 102/336 |

OTHER PUBLICATIONS

U.S. S.I.R. #H 1522 by Campillo et al, Entitled *Laser–Mounted Aerosol Infrared Decoy,* Apr. 1996.

*Primary Examiner*—Peter A. Nelson
*Attorney, Agent, or Firm*—Larson & Taylor

[57] ABSTRACT

A decoy flare for infrared (IR) seeking missiles comprises a tubular shell with a cover member hermetically sealed to an outer front edge of the tubular shell to form a container for a pyrophoric liquid. The cover member has a central rupturing disc that ruptures at a predetermined pressure, a nozzle cap with a nozzle opening being attached to the cover member adjacent an exterior surface of that rupturing disc. Pressure applied by a mechanism to the pyrophoric liquid can rupture the rupturing disc and eject the pyrophoric liquid through the nozzle. A pre-heating chamber formed by an enclosure surrounds the nozzle opening in order to provide for more reliable ignition of the pyrophoric liquid at high altitudes and low flow rates, that enclosure having an outer surface containing a number of perforations through which air can enter the pre-heating chamber and through which pyrophoric liquid can be ejected from the chamber into the atmosphere.

10 Claims, 4 Drawing Sheets

NOZZLES FOR PYROPHORIC IR DECOY FLARES

FIELD OF THE INVENTION

The present invention relates to decoy flares for infrared seeking missiles and in particular to a countermeasure flare containing a pyrophoric liquid which reacts and burns on exposure to air as the liquid is ejected from a flare's nozzle, the nozzle having a configuration to provide for improved combustion of the pyrophoric liquid.

BACKGROUND OF THE INVENTION

First generation infrared (IR) guided missiles could possibly be avoided by pilot manoeuvres that consisted of pointing a targeted aircraft in the direction of the sun to blind the IR missile's detector system or by launching decoy flares onto which the missiles detector would lock and decoy the missile away from the aircraft. Current decoy flares are generally of the pyrotechnic type which produces radiation by combustion of solid pyrotechnic compositions. The most commonly used composition, named MTV composition, is composed of magnesium, Teflon* and Viton*. This MTV composition produces a very hot flame and provides an intense point source of IR radiation that should attract this first generation of IR guided missiles. However, advances in missile's IR seekers have significantly reduced the effectiveness of currently fielded pyrotechnic flares. None of the known systems offers the required protection performance against these newer missiles.

*Trade Mark

The new generation of IR guided missiles are equipped with one or more electronic counter-countermeasures (CCM) that can discriminate between an aircraft and a decoy, ignoring present aircraft protective countermeasures such as the current decoy flares. New IR guided missiles equipped with spectral CCM have detection systems that can usually distinguish and analyze three bands in the spectral emissions of aircrafts. Therefore, any detected signal in which the band intensities and ratios do not conform to the target aircraft's spectral signature would be recognized as a countermeasure and ignored. Countermeasure flares now would, as a result, have to produce a spectral signature similar to those of aircrafts in order to be effective. This is not the case with present pyrotechnic flares. Pyrotechnic flare's spectral signature are, in fact, very different from that of an aircraft because they emit principally in the first spectral band that would be analyzed by newer guided missiles IR seeker equipped with spectral CCM, whereas a jet aircraft's signature shows high intensities in the second and third bands. This spectral mismatched signature generally limits the usefulness of current pyrotechnic flares to the previous generation of IR guided missiles.

Operational analysis, based on measured experimental flare performance, show that pyrophoric flares offer a strong potential to provide the required performance to decoy the newer generation of IR seeking missiles. The spectral signature of a pyrophoric liquid, such as alkyl aluminum compounds that burn spontaneously when sprayed into the air, more closely resemble a jet aircraft's spectral signature so that an IR seeking missile would not recognize that type of flare as a countermeasure.

The basic functioning principles of any pyrophoric flare would have very little in common to the existing pyrotechnic flares except for the fact that they are both ejected from a launcher by an impulse cartridge. A pyrophoric flare would require a liquid in a perfectly sealed reservoir since pyrophoric liquids react and burn on exposure to air using the oxygen of the air as an oxidant. Pyrotechnic flares, on the other hand, use a solid grain composition contained in a protective shell. Some means would be required in a pyrophoric flare to eject the pyrophoric liquid through a calibrated nozzle such as a gas generator to provide a certain pressure profile inside the flare to break rupturing discs and eject the liquid. Therefore, a high stress resistance container and special sealing component attachments would be required for a pyrophoric flare. These items are not required for a pyrotechnic flare. In addition, mobile and/or removable components of the ignition system for any pyrophoric flare would require special sealing devices to prevent any pressure leaks through the ignition system during the whole functioning of the flare. This is not a concern for a pyrotechnic flare. Furthermore, pyrophoric liquids, such as alkyl aluminum compounds, are incompatible with many materials and especially with most polymers. These constraints require a completely new design for pyrophoric flares such as that described in U.S. Pat. No. 5,631,441 which issued on the $20^{th}$ of May 1997.

The decoy flare described in U.S. Pat. No. 5,631,441 comprises a tubular container for pyrophoric liquid with a nozzle at one end which is normally separated from pyrophoric liquid in the container by a rupturing disc, the other end of the container being provided with a mechanism to apply pressure to the pyrophoric liquid. That pressure is transferred by the liquid to the rupturing disc that will rupture at a predetermined pressure and result in the pyrophoric liquid being ejected through the nozzle into the atmosphere where the pyrophoric liquid burns on exposure to the air. The nozzle configuration shown in U.S. Pat. No. 5,631,441 was a straight hole drilled through a nozzle cap. This nozzle design is very effective for high flow rates of the pyrophoric liquid fuel under all conditions. High flow rates result in short burn times for a flare. The flow rate of the pyrophoric liquid through this nozzle is dependent on the pressure on the liquid and diameter of the straight nozzle. That type of nozzle was, however, found to be less effective and not appropriate for low flow rates of the pyrophoric liquid that may be desired in order to provide longer burning times and, in particular, for low flow rates at high altitudes. It is assumed that this less effective performance for low flow rates at high altitudes is due to a reduced concentration of pyrophoric liquid fuel being sprayed into a very cold air (less reactive) environment having a substantially reduced quantity of reactive oxygen.

SUMMARY OF THE INVENTION

It is an object of the present invention to provide a decoy flare for infrared (IR) seeking missiles wherein the flare contains a pyrophoric liquid that can be ejected through a nozzle into the atmosphere, the nozzle having a configuration to provide for improved combustion of the pyrophoric liquid at low flow rates through the nozzle and, in particular, for low flow rates at high altitudes.

A decoy flare for infrared seeking missiles according to one embodiment of the present invention comprises a tubular shell with a cover member hermetically sealed to an outer front edge of the tubular shell which forms a container for a pyrophoric liquid located in the tubular shell, the cover member having a central rupturing disc that ruptures at a predetermined pressure with a nozzle cap having a nozzle opening being attached to the cover member adjacent an exterior surface of the rupturing disc, the nozzle opening being located in front of that exterior surface, the flare having a pressure generating mechanism for applying pressure to the pyrophoric liquid to rupture the rupturing disc and eject the pyrophoric liquid through the nozzle opening wherein that nozzle opening opens into a pre-heating chamber located in front of the cover member, the pre-heating chamber being formed by an enclosure surrounding the nozzle opening which enclosure has an outer surface spaced from the nozzle opening, the outer surface having a number of perforations through which air can enter the pre-heating chamber and through which pyrophoric liquid can be ejected from the chamber into the atmosphere.

A decoy flare for infrared seeking missiles according to a further embodiment of the present invention comprises a tubular shell with a cover member hermetically sealed to an outer front edge of the tubular shell which forms a container for a pyrophoric liquid located in the tubular shell, the cover member having a central rupturing disc that ruptures at a predetermined pressure with a nozzle cap having a nozzle duct being attached to the cover member adjacent an exterior surface of the rupturing disc, the nozzle duct being located in front of that exterior surface, the flare having a pressure generating mechanism for applying pressure to the pyrophoric liquid to rupture the rupturing disc and force the pyrophoric liquid through the nozzle duct and further having a pre-heating chamber formed by an enclosure in front of the nozzle duct which has an outer surface spaced from the nozzle duct, the outer surface having a rearwardly protruding hub with a plurality of nozzle output ducts having openings on a surface of the hub, the output ducts opening into a rearwardly extending central opening of the hub, the rearwardly extending central opening being aligned with and connected to the nozzle duct in the nozzle cap, the outer surface of the enclosure having a number of perforations through which air can enter the pre-heating chamber and through which pyrophoric liquid can be ejected from the chamber into the atmosphere.

BRIEF DESCRIPTION OF THE DRAWINGS

The following detailed description of the invention will be more readily understood when considered in conjunction with the accompanying drawings, in which.

DESCRIPTION OF THE PREFERRED EMBODIMENTS

Figure 1:
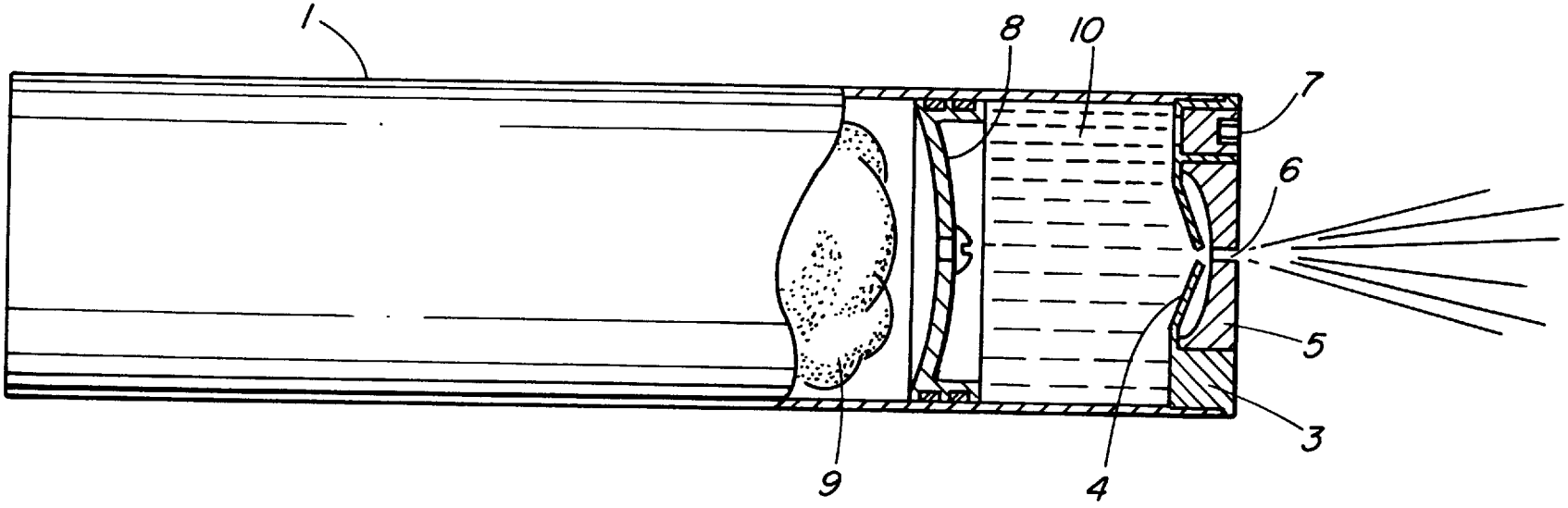
PRIOR ART FIG. 1
FIG. 1 is a partial cross-sectional view of a known pyrophoric liquid decoy flare for infrared (IR) seeking missiles.

FIG. 1 illustrates a known pyrophoric liquid decoy flare for infrared IR seeking missiles. That flare has a tubular shell 1 and front cover assembly 3 which form a container for pyrophoric liquid 10. The front cover assembly 3 has a filling plug 7, a central rupturing disc 4 formed as a single piece with the cover, and an outer edge that is sealed to the front inner edge of tubular shell 1. The central rupturing disc 4 is a solid disc before the flare is activated which, with the cover, forms a hermetic seal for the pyrophoric liquid in tubular shell 1 until a predetermined pressure in the container is reached. At that predetermined pressure, the disc 4 will be ruptured allowing pyrophoric liquid to be ejected as illustrated in FIG. 1. A nozzle cap 5 with a central calibrated nozzle 6 is mounted onto the front of cover assembly 3 in a position such that nozzle 6 is located in front of disc 4. The pyrophoric liquid 10 is separated from the rear of tubular shell 1 by a piston 8 and a gas generating mechanism (not shown) when activated increases the pressure of gas 9 behind the piston 8 to press it forward against the pyrophoric liquid 10 until, at a predetermined pressure, the disc 4 ruptures and pyrophoric liquid is ejected though nozzle 6. That pyrophoric liquid will spontaneously ignite upon exposure to the atmosphere as it is ejected from nozzle 6. This type of flare is described in U.S. Pat. No. 5,631,441.

The flow rate of the pyrophoric liquid through calibrated nozzle 6 in the flare illustrated in FIG. 1 will depend on the diameter of nozzle 6 and the pressure that piston 8 applies to the pyrophoric liquid 10, i.e. the pressure being generated by gas 9. The calibrated nozzle 6, as shown in FIG. 1, has the configuration of a straight hole drilled through the nozzle cap 5. This straight hole type of nozzle is very effective for high flow rates of the pyrophoric liquid fuel in all conditions. These high flow rates result in short burn times for the flare. That straight nozzle configuration was, however, found to be less appropriate for efficient combustion of the pyrophoric fuel at low flow rates which provide a longer burning time and, in particular, for low flow rates at high altitudes. The combustion problems associated with low flow rates at high altitudes is assumed to be caused by a reduced concentration of pyrophoric liquid fuel sprayed into a very cold air (less reactive) environment having a substantially reduced quantity of reactive oxygen.

The infrared (IR) signature of a pyrophoric flare, such as described in U.S. Pat. No. 5,631,441, is a function of three components as follows:

(1) the gas generator, which determines the pressure at which the pyrophoric liquid is ejected, (2) the rupturing disc, which ruptures at a predetermined pressure, and (3) especially the configuration of the nozzle.

The addition of a small "pre-heating cavity" for the pyrophoric liquid fuel in the nozzle configuration was found to be an appropriate solution to the combustion problems encountered with low flow rates at high altitudes. There are various configurations for a nozzle with a "pre-heating cavity" which can be designed to provide appropriate IR signatures. The basic principal of a "pre-heating cavity" is to first spray (through a nozzle) the pyrophoric liquid fuel into a chamber that is partially opened to the surrounding air flow environment. That chamber forms a "pre-heating cavity" where the sprayed pyrophoric liquid fuel reacts with the trapped air in the cavity before it is finally ejected out of the cavity into the atmosphere. This allows heating of the pyrophoric fuel in the cavity to occur which increases its reactivity to permit the ignition and combustion of the pre-heated pyrophoric liquid fuel at high altitudes and in very cold environments. The pyrophoric fuel droplet sizes that are sprayed into the atmosphere are, moreover, modified by this configuration of a nozzle with a pre-heating chamber which results in important effects on the flare's IR signature.

Figure 2A:
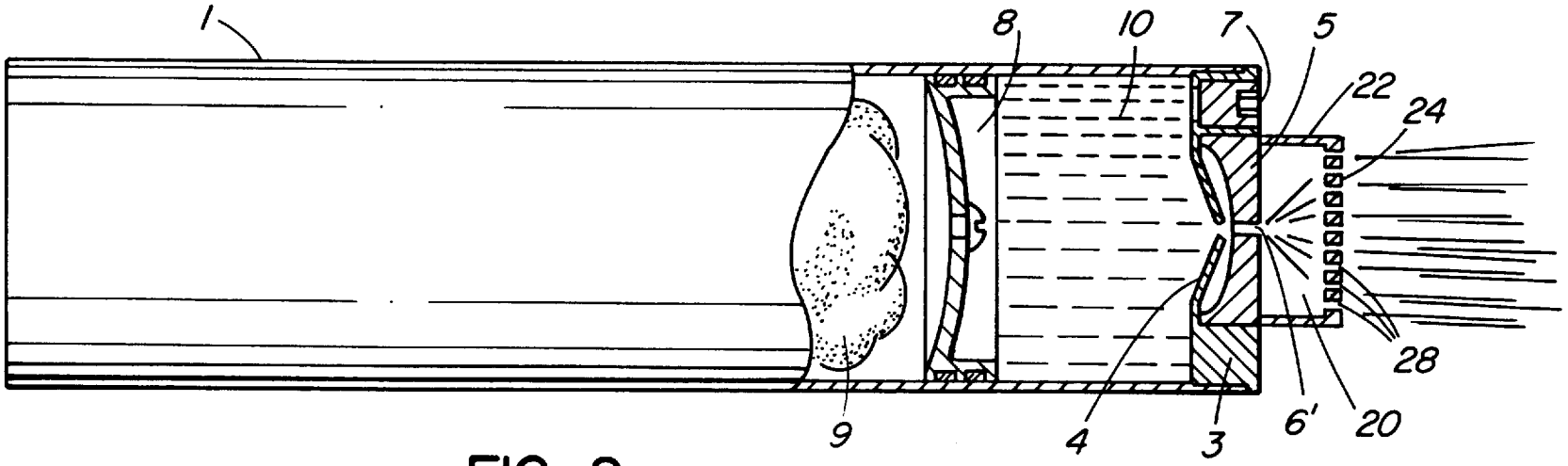
FIG. 2*a* is a partial cross-sectional view of a decoy flare containing pyrophoric liquid with a nozzle configuration according to one embodiment of the present invention.
Figure 2B:
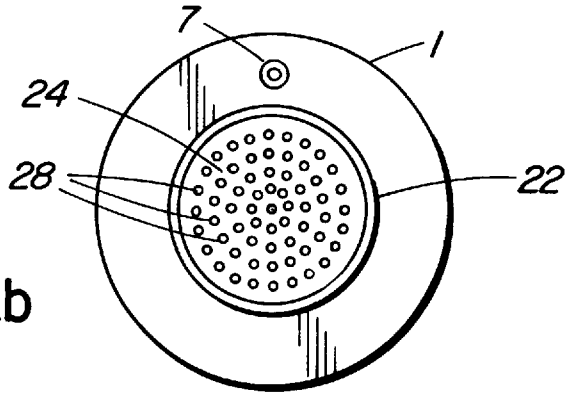
FIG. 2*b* is a front view of the flare shown in FIG. 2*a;*

FIG. 2*a* is a partial cross-sectional view of a preferred embodiment of the present invention in which the main nozzle duct 6', nozzle cap 5, rupturing disc 4, tubular shell 1 and piston 8 are identical to the same elements illustrated in FIG. 1. In this embodiment, however, the main nozzle duct 6', opens into a pre-heating cavity 20 formed by a circular shroud 22 extending outward from the edge of nozzle cap 5. The shroud 22 surrounds the main nozzle duct 6' to form a pre-heating cavity 20. The open end of tubular shroud 22 is closed by a perforated disc 24 containing a large number of small openings 28 as best illustrated in the front view shown in FIG. 2(*b*). The perforated disc 24 allows air to enter the pre-heating cavity 20. In this nozzle design, the pyrophoric liquid fuel is forced to enter, via pressure due to piston 8, into the pre-heating cavity 20 through only one central duct, the main nozzle duct 6'. The pyrophoric liquid fuel sprayed into pre-heating cavity 20 via duct 6' reacts with the air inside of cavity 20, pre-heating the liquid fuel, before it is ejected to the atmosphere through the perforated disc 24. The pre-heating of the pyrophoric liquid in cavity 20 eliminates previous problems encountered with ignition of the liquid at low flow rates and at high altitudes.

Figure 3:
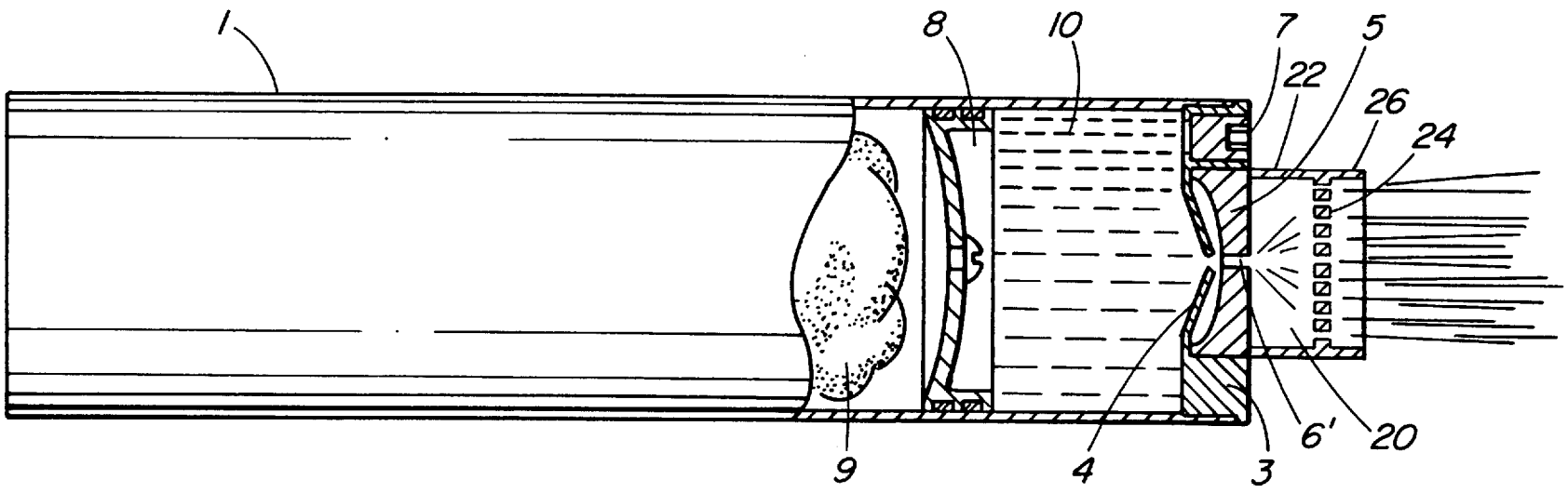
FIG. 3 is a partial cross-sectional view of a decoy flare with a modified configuration of the nozzle arrangement shown in FIG. 2*a*.

The basic functioning principle for the pyrophoric flare shown in FIG. 2*a* is similar to the prior art flare illustrated in FIG. 1 but the FIG. 2*a* Shroud/Perforated Disc nozzle design produce a very different radiometric output (the flare's IR signature) and it offers more versatility. An Extended Shroud protruding, for instance, forward of the perforated disc is one modification that may be used to alter the IR signature. This is illustrated in FIG. 3 wherein a flange 26 extends outward from tubular shroud 22 past the perforated disc 24. That extension of the shroud 22 modifies the radiometric output (signature) of the flare from that which would be obtained without any extension. Other modifications that substantially affects the signature of the flare are ones such as replacing the perforated disc 24 by a perforated dome or by adding non-combustible fibers to the cavity which acts as a sponge for the liquid fuel or by changing the diameter and number of perforations. The latest modification may include combinations of different size perforations and their patterns. Furthermore, both the flare burn time and radiometric output can be varied by changing the diameter of the main nozzle duct 6'.

Figure 4:
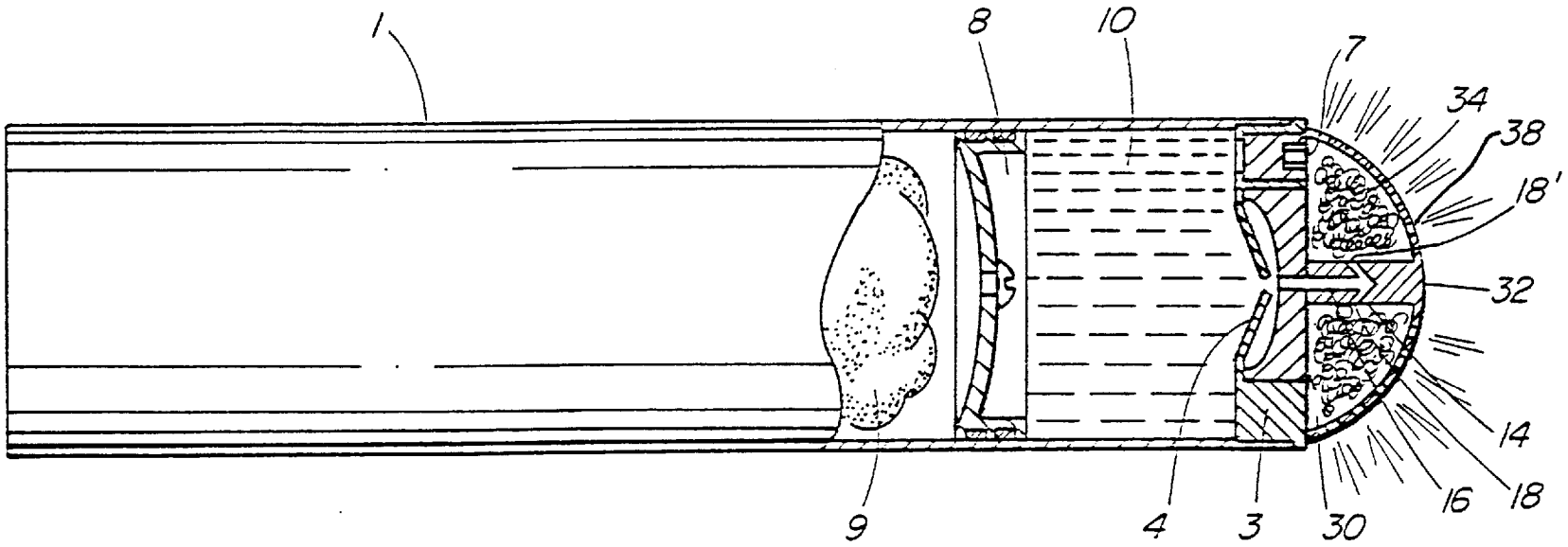
FIG. 4 is a partial cross-sectional view of a decoy flare with a nozzle configuration according to another embodiment of the present invention.

FIG. 4 shows another embodiment of a pyrophoric flare according to the present invention wherein the rupturing disc 4, shell 1 and piston 8 are similar to those shown in the previous embodiments. The "pre-heating cavity" 30 is, in this embodiment, formed by a perforated dome 32 having a large number of perforations 38 open to the atmosphere. The dome 32 is attached to the exterior of the front cover assembly 3. In this embodiment, the main nozzle duct 16 does not open directly towards the front of the dome 32 but feeds into two (branching) output ducts 18 and 18' in a central rearwardly facing hub 14 of dome 32, that hub having an axial rearwardly extending central opening between the branching ducts and an aligned opening of main duct 16 to which that central opening is connected. The branching ducts (18, 18') are at an angle to that axial extending central opening and open into the "pre-heating cavity" 30 formed between the dome 32 and front cover assembly 3. The interior of the "pre-heating cavity" 30 is filled with non-combustible fibers 34 (steel wool, asbestos, etc.) which acts like a sponge for the pyrophoric liquid as it is ejected from the output ducts 18 and 18' and sprayed onto the fibers under pressure created by piston 8. Air enters the dome 32 via the perforations 38 and the pyrophoric liquid, trapped for a short time by the fibers 34, reacts with the air inside cavity 30 to form a "pre-heating cavity". The air flow surrounding the flare and the pressure produced by new pyrophoric liquid entering cavity 30 forces the pre-heated pyrophoric liquid in the cavity to exit through the small holes of the perforated dome 32 into the atmosphere where spontaneous combustion will occur.

In the embodiment shown in FIG. 4, the flare burn times can be varied by changing the main and/or output ducts diameter, the number of output ducts and/or their orientation with respect to the main duct. This flare's IR signature can also be altered by changing the diameter and/or the number of holes in the perforated dome or by changing the pattern of the perforations. The IR signature, furthermore, may also be varied by altering the density of fibers in the cavity or by removing those fibers entirely.

Various modifications may be made to the preferred embodiments without departing from the spirit and scope of the invention as defined in the appended claims. A catalytic coating, for instance, may be applied to the non-combustible fibers if the fibers are included in the "pre-heating cavity".

The embodiments of the invention in which an exclusive property or privilege is claimed are defined as follows:

1. A decoy flare for infrared (IR) seeking missiles comprising a tubular outer shell with a cover member hermetically sealed to an outer front edge of the tubular shell which forms a container for a pyrophoric liquid located in the tubular shell, the cover member having a central rupturing disc that ruptures at a predetermined pressure with a nozzle cap having a nozzle opening being attached to the cover member adjacent an exterior surface of the rupturing disc, the nozzle opening being located in front of that exterior surface, the flare having a pressure generating mechanism for applying pressure to the pyrophoric liquid to rupture the rupturing disc and eject the pyrophoric liquid through the nozzle opening wherein that nozzle opening opens into a pre-heating chamber located in front of the cover member, the pre-heating chamber being formed by an enclosure surrounding the nozzle opening which enclosure has an outer surface spaced from the nozzle opening, the outer surface having a number of perforations through which air can enter the pre-heating chamber and through which pyrophoric liquid can be ejected from the chamber into the atmosphere.

2. A decoy flare as defined in claim 1 wherein the enclosure is formed by a shroud that extends outward from the nozzle cap and which surrounds the nozzle opening, the outer surface being a perforated disc positioned in an opening at an outer edge of the shroud.

3. A decoy flare as defined in claim 2, wherein a flange at the outer edge of the shroud extends forward of the perforated disc.

4. A decoy flare as defined in claim 1, wherein the enclosure is a shroud formed by a tubular protrusion that extends outward from the nozzle cap and surrounds the nozzle opening, the outer surface being a perforated dome positioned in an outward facing opening of the tubular protrusion.

5. A decoy flare as defined in claim 4, wherein the dome has a concave inner surface facing the nozzle opening and a flange at an outer edge of the tubular protrusion extends forward of an inner edge of the dome.

6. A decoy flare as defined in claim 1, wherein the pre-heating chamber contains a mass of non-combustible fibers.

7. A decoy flare as defined in claim 6, wherein the non-combustible fibers are steel wool.

8. A decoy flare for infrared seeking missiles comprising a tubular shell with a cover member hermetically sealed to an outer front edge of the tubular shell which forms a container for a pyrophoric liquid located in the tubular shell, the cover member having a central rupturing disc that ruptures at a predetermined pressure with a nozzle cap having a nozzle duct being attached to the cover member adjacent an exterior surface of the rupturing disc, the nozzle duct being located in front of that exterior surface, the flare having a pressure generating mechanism for applying pressure to the pyrophoric liquid to rupture the rupturing disc and force the pyrophoric liquid through the nozzle duct and further having a pre-heating chamber formed by an enclosure in front of the nozzle duct which has an outer surface spaced from the nozzle duct, the outer surface having a central rearwardly protruding hub with a plurality of nozzle output ducts having openings on surfaces of the hub, the output ducts opening into a rearwardly extending central opening of the hub, the rearwardly extending central opening being aligned with and connected to the nozzle duct in the nozzle cap, the outer surface of the enclosure having a number of perforations through which air can enter the pre-heating chamber and through which pyrophoric liquid can be ejected from the chamber into the atmosphere.

9. A decoy flare as defined in claim 8 wherein the enclosure is a perforated dome whose edge meets an outer surface of the cover member.

10. A decoy flare as defined in claim 9, wherein the enclosure contains a mass of non-combustible fibers.

* * * * *